US006224455B1

(12) United States Patent
Laurienzo

(10) Patent No.: US 6,224,455 B1
(45) Date of Patent: May 1, 2001

(54) TOY FIGURE SIMULATING MUSICAL INSTRUMENT PLAY

(75) Inventor: Dominic Laurienzo, Los Angeles, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/631,820

(22) Filed: Aug. 3, 2000

(51) Int. Cl.[7] ..... A63H 3/28
(52) U.S. Cl. ..... 446/297; 446/298; 446/408
(58) Field of Search ..... 446/297, 298, 446/303, 408, 330, 352, 353

(56) References Cited

U.S. PATENT DOCUMENTS

| | | | |
|---|---|---|---|
| 1,332,732 | * | 3/1920 | Lizzi . |
| 1,571,674 | | 2/1926 | Kingsley . |
| 1,770,455 | | 7/1930 | Berger . |
| 2,137,371 | * | 11/1938 | Marsh . |
| 2,148,010 | * | 2/1939 | Bowers . |
| 3,477,171 | * | 11/1969 | Bonanno . |
| 4,068,403 | | 1/1978 | Weiser . |
| 4,271,744 | | 6/1981 | Kulesza . |
| 4,451,911 | | 5/1984 | Klose et al. . |
| 4,521,205 | | 6/1985 | Spector . |
| 4,540,176 | * | 9/1985 | Baer . |
| 4,601,669 | * | 7/1986 | Hsieh . |
| 4,802,878 | * | 2/1989 | Terzian . |
| 5,011,449 | | 4/1991 | Handy et al. . |
| 5,468,172 | | 11/1995 | Basile . |
| 5,738,561 | | 4/1998 | Pracas . |

* cited by examiner

*Primary Examiner*—Jacob K. Ackun, Jr.
*Assistant Examiner*—Bena B. Miller
(74) *Attorney, Agent, or Firm*—Roy A. Ekstrand

(57) ABSTRACT

A toy figure includes a head, torso, arms and legs conforming generally to a plush figure. The head defines a mouth and the arms are pivotally secured to the torso. The arms each support a hand between which a simulated harmonica is secured. The arms and simulated harmonica are pivotable between and arms lowered position to an intermediate arms forward position and to an arms raised position. In the arms raised position, the simulated harmonica is placed against the mouth providing a harmonica play posture. A sound and control circuit within the torso of the toy figure respond to arm position to provide silence in the arms lowered position, speech or singing in the arms forward position, and harmonica music in the arms raised position. A light emitting diode is supported within the transparent body of the simulated harmonica and is caused to flash by the sound and control circuit when the arms are raised to the harmonica play posture.

4 Claims, 3 Drawing Sheets

TOY FIGURE SIMULATING MUSICAL INSTRUMENT PLAY

FIELD OF THE INVENTION

This invention relates generally to toy figures and particularly to those having sound producing apparatus therein.

BACKGROUND OF THE INVENTION

Through the years practitioner's in the toy art have provided a great number of toy figures and dolls. In attempting to advance the toy arts associated with such toy figures and dolls, practitioner's have provided a virtually endless variety thereof. One approach to enhancing dolls and toy figures has been found in providing one or more so-called action features.

Thus, toy figures have been provided which perform action features such as walking, talking and skating to name a few. With the advent of low-cost mass-produced digital electronic sound and speech circuitry, practitioner's have been quick to add features such as speech, singing and/or music to dolls and toy figures. For example, U.S. Pat. No. 5,738,561 issued to Pracas sets forth a TALKING DOLL having a microphone and sound recording device along with a sound playback device and speaker. The doll is provided with contacts or buttons to activate the sound recording device and the sound playback device. A child may speak to the doll and record messages, which may be played back at a later time.

U.S. Pat. No. 4,068,403 issued to Weiser sets forth a FINGER OPERATED MAGICIAN SIMULATING ANIMATED TOY having a hollow base which supports a hollow upright animal figure which in turn includes a pair of swingable arms. A housing communicates with, and is located upon the base in front of the figure. The housing includes a slot through which panels are vertically slidable. A plurality of levers are housed in the base and include exposed buttons. A lever is coupled to each arm of the figure and to each panel to individually swing the arms and raise and lower the panels. As the buttons are pushed, the figures arms are moved simulating independent action of the figure.

U.S. Pat. No. 5,011,449 issued to Handy et al. sets forth an APPENDAGE MOTION RESPONSIVE DOLL having a body defining a torso portion and outwardly extending leg and arm appendages. The body further supports a neck and head. The arm appendages are pivotally secured to the torso to permit motion thereof. The arms are further fabricated in a manner permitting bending or flexing the arm appendages. One or more sensors are supported within one or more of the arms to provide signals when the arms are bent. An internally supported voice unit produces a selected group of sounds responsive to the degree of motion signals provided as the arm is bent.

U.S. Pat. No. 5,468,172 issued to Basile sets forth a DOLL INCLUDING RECORDED MESSAGE MEANS having a head, a body and a motorized appendage for proving a caress. The doll further includes a recorder for recording a personal message. The doll also includes disengagement means for disengaging the motor upon an applied force exceeding a predetermined threshold level.

U.S. Pat. No. 4,271,744 issued to Kulesza sets forth a MUSICAL TOY having a bellows for creating a flow of air and an air tube connecting the bellows to a musical instrument such as a harmonica. The musical instrument is selectively moved relative to the outlet of the air tube to create different tones as the bellows are operated to provide air flow.

U.S. Pat. No. 1,571,674 issued to Kingsley sets forth a MECHANICAL TOY having a base supporting a human-like toy figure which includes wind-up drive motor mechanism and a movable arm. The toy figure holds a simulated slide trombone having a movable slide joined to the movable arm. As the wind-up drive unit operates the arm is moved to manipulate the slide of the trombone. Means within the torso of the figure are also driven by the wind-up drive mechanism to produce music.

U.S. Pat. No. 1,770,455 issued to Berger sets forth a MECHANICALLY OPERATED FIGURE TOY having a housing upon which a plurality of figures are supported. A wind-up mechanism within the housing drives a plurality of articulating crack members which in turn operate the arms supported upon the housing associated with each figure.

U.S. Pat. No. 4,451,911 issued to Klose et al. sets forth an INTERACTIVE COMMUNICATING TOY FIGURE having a doll including electronic control circuitry which responds to selection of one of a plurality of switches on the doll. In response, the control circuitry selects associated vocal messages. The control circuitry includes a stored program of instructions and also permits a problem-solution mode of operation.

U.S. Pat. No. 4,521,205 issued to Spector sets forth a SOUND TAPE PLAYER HAVING ANIMATED CHARACTER having a player for pre-recorded sound magnetic tape packages in a cartridge or cassette format together with a three-dimensional character related to the recording. The character is provided with eye and mouth openings covered by translucent elements. Within the character, light guides extend upwardly from a light source to the eye and mouth elements. As recorded sound is produced, the light emitted by the light source is modulated in accordance therewith.

While the foregoing described prior art devices have to some extent improved the art and have in some instances enjoyed commercial success, there remains nonetheless a continuing need in the art for ever more improved, interesting and amusing toy figures having associated sound and music play.

SUMMARY OF THE INVENTION

Accordingly, it is a general object of the present invention to provide an improved toy figure. It is a more particular object of the present invention to provide an improved toy figure capable of producing musical sounds in response to play activity.

In accordance with the present invention there is provided a toy figure comprising: a toy figure body having a torso, a pair of legs, a pair of arms, and a pair of hands supported on the arms and a head defining a mouth; a pair of shoulder joints pivotally supporting the arms at the torso for movement between an arms lowered position, an arms forward position and a arms raised position; a common shaft joining the shoulder joints to provide common pivotal movement of the pair of arms; a simulated musical instrument secured between the hands; a sound and control circuit supported within the torso for producing first audible sounds and second audible sounds; switch means coupled to the pair of shoulder joints operative in the arms forward position to cause the sound and control circuit to produce the first audible sounds and operative in the arms raised position to cause the sound and control circuit to produce the second audible sounds, the arms raised position positioning the simulated musical instrument against the mouth to posture the toy figure to simulate play of a musical instrument.

BRIEF DESCRIPTION OF THE DRAWING

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
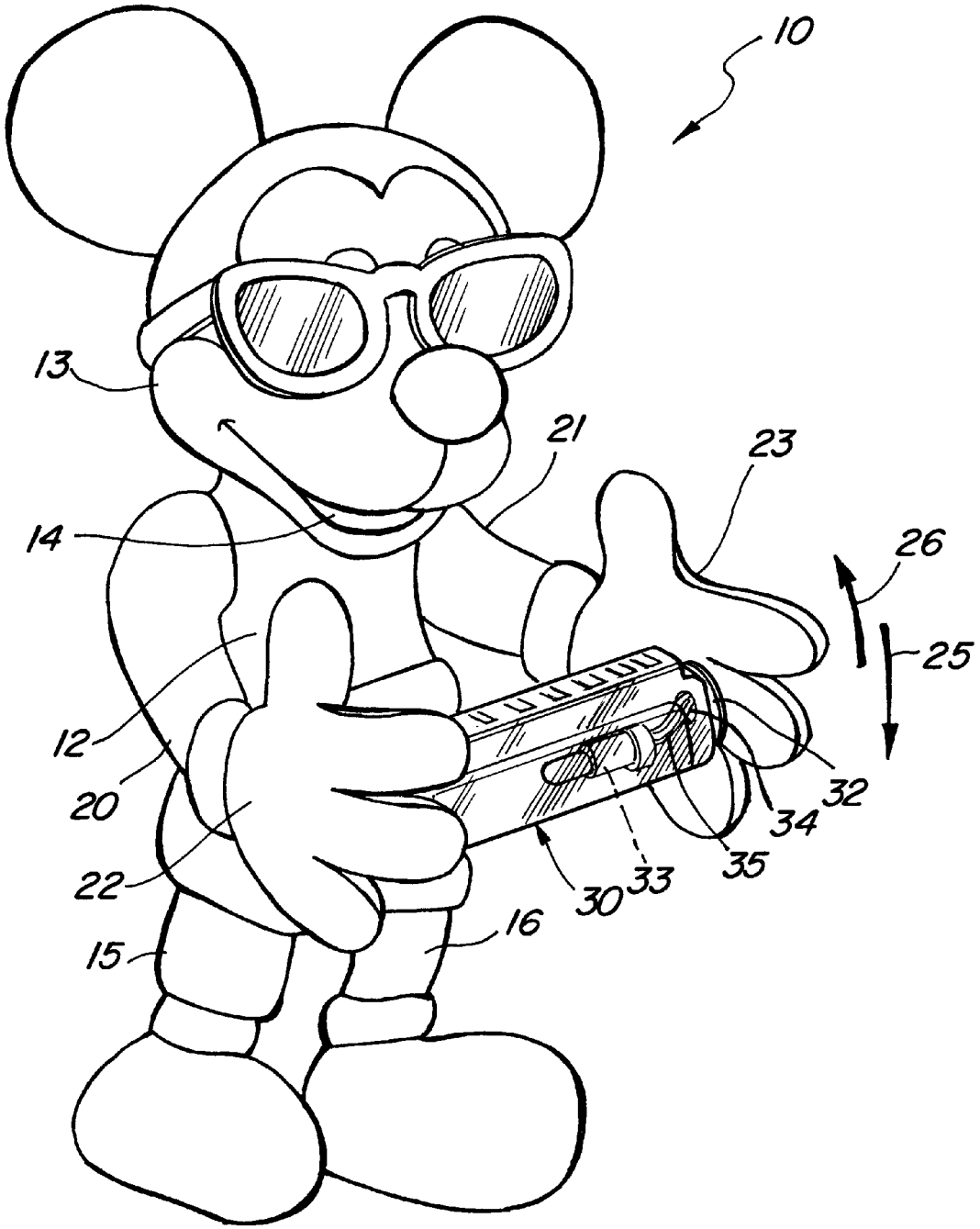
FIG. 1 sets forth a front perspective view of toy figure constructed in accordance with the present invention.

FIG. 1 sets forth a front perspective view of a toy figure constructed in accordance with the present invention and generally referenced by numeral 10. Toy FIG. 10 includes a plush body 11 fabricated generally in accordance with conventional fabrication techniques, and having a flexible outer cloth "skin" covering a padded interior body. Thus, body 11 includes a torso 12 supporting a head 13 and a pair of arms 20 and 21. Torso 12 is supported by a pair of legs 15 and 16. Arms 20 and 21 support respective hands 22 and 23. Head 13 defines simulated mouth portion 14.

In accordance with the present invention, a simulated harmonica 30 preferably formed of a material such as molded plastic or the like and preferably having a light transmissive body such as transparent tinted plastic is generally referenced by numeral 30. Simulated harmonica 30 supports a light source which in the embodiment of FIG. 1 includes a light emitting diode 33. In further accordance with the present invention, simulated harmonica 30 is secured to hand 23 by an attachment 32 and as is better seen in FIG. 2, is similarly secured to hand 22 by an attachment 31.

A plurality of connecting wires 35 couple light emitting diode 33 to sound and control circuit 44 (seen in FIG. 2) operative within torso 12.

Figure 2:
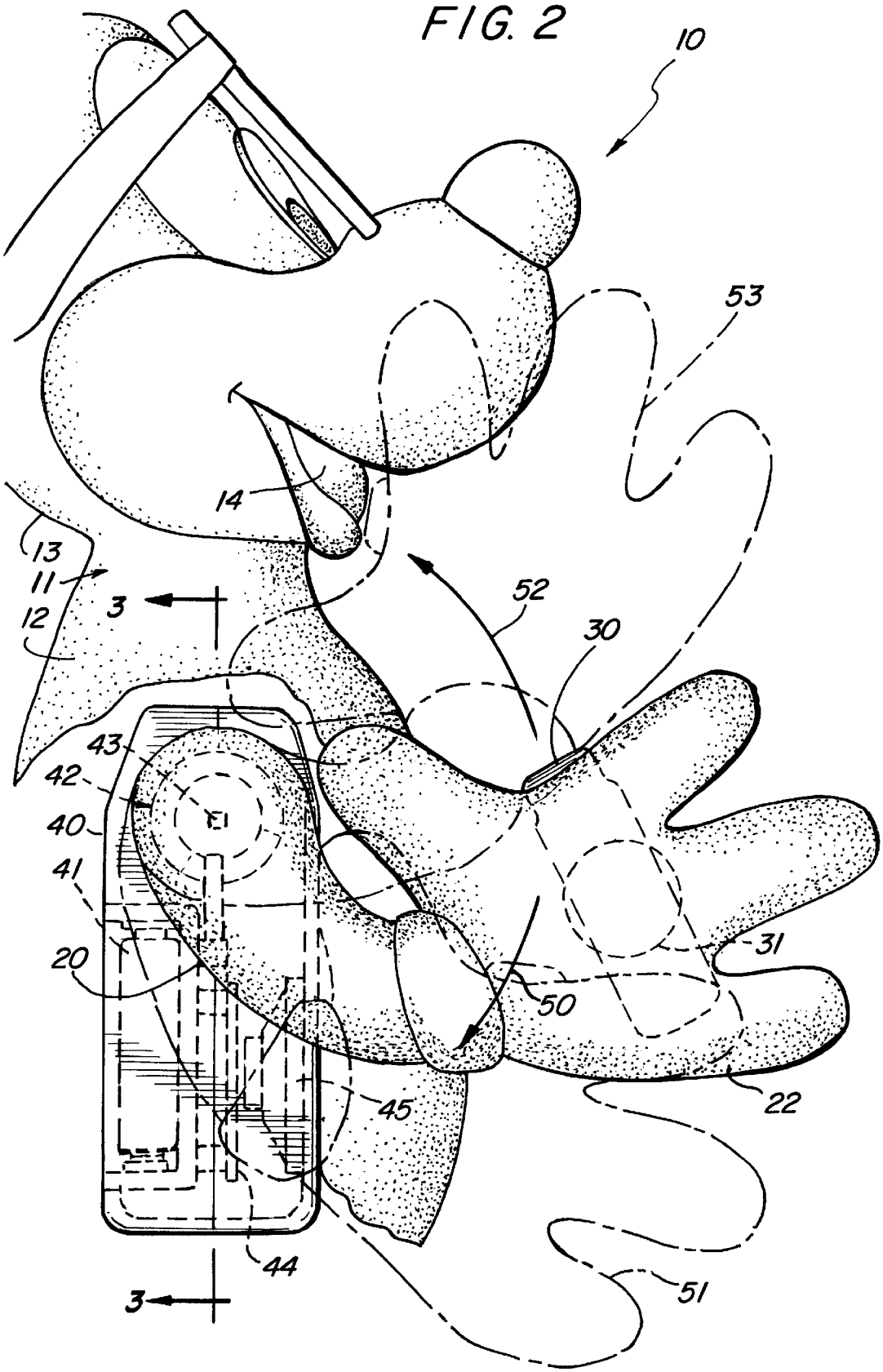
FIG. 2 sets forth a partial section side elevation view of the present invention toy figure.

In accordance with the present invention and as is better seen in FIG. 2, arms 20 and 21 are pivotally secured to torso 12 such that hands 22 and 23 and arms 20 and 21 may be positioned at either a lower hand position (dash-line position 51), a forward extension position (seen in solid-line representation in FIG. 2), or a fully raised position 53 (shown in dash-line representation in FIG. 2). Thus, returning to FIG. 1, arms 20 and 21 as well as hands 22 and 23 are shown in the forward extension position. As a result, simulated harmonica 30 is held in a forwardly extended position between hands 22 and 23. In further accordance with the present invention, arms 20 and 21 and hands 22 and 23 may be lowered in the direction indicated by arrow 25 to position toy FIG. 10 in a hands lowered position. Alternatively, arms 20 and 21 and hands 22 and 23 may be raised upwardly from the arms forward position shown in FIG. 1 in the direction indicated by arrow 26. As arms 20 and 21 pivot hands 22 and 23 upwardly in the direction indicated by arrow 26, simulated harmonica 30 is brought into proximity with mouth 14. This provides a posture simulating a typical harmonica playing activity. In accordance with the operation of control and sound circuit 44, (seen in FIG. 3) and the operation of shoulder joints 42 and 46, (also seen in FIG. 3) light emitting diode 33 is caused to flash and harmonica playing music is produced by toy FIG. 10. In this manner, harmonica playing is simulated in an amusing fashion. It has been found that the flashing of light emitting diode enhances the amusement value of this operation.

In further accordance with the present invention, the positioning of arms 20 and 21 in the forwardly position shown in FIG. 1 causes sound circuit 44 (seen in FIG. 2) to produce a different sound such as talking or singing rather than harmonica music. Finally, with arms 20 and 21 pivoted downwardly in the direction indicated by arrow 25 to the arms lowered position, the sound output of control circuit is terminated. Thus, the user is able to determine the sound being produced as toy FIG. 10 responds to the position of arms 20 and 21. Of particular importance is the simulated harmonica play achieved as arms 20 and 21 are pivoted fully upwardly to play simulated harmonica 30 against mouth 14 and to play harmonica music with accompanying flashing of light emitting diode 33.

FIG. 2 sets forth a partial section side view of toy FIG. 10. As described above, toy FIG. 10 includes a body 11 having a torso 12 supporting a head 13. Head 13 defines a mouth 14. Torso 10 further supports an arm 20 a shoulder joint 42 in a pivotal attachment. Torso 12 further supports a housing 40 within which a plurality of batteries 41 and a sound and control circuit 44 are supported. Shoulder joint 42 includes a shaft 43 extending through the rotating portion of shoulder joint 42 described below. A speaker 45 is supported within housing 40 and is operative coupled to sound and control circuit 44.

In accordance with the present invention, arm 20 having hand 22 is shown in solid-line representation in FIG. 2 in its middle or intermediate position corresponding to an arms forward position. As described above, arm 20 (and arm 21 shown in FIG. 1) supports a simulated harmonica 30 between hands 22 and 23 (hand 23 seen in FIG. 1). Thus, simulated harmonica 30 is secured to hand 22 by an attachment 31.

In accordance with the present invention, arm 20 and arm 21 (seen in FIG. 1) may be pivoted downwardly in the direction indicated by arrow 50 to the lowered hand position shown by dashed outline 51. When so positioned, and by means set forth below in greater detail, sound and control circuit 44 does not produce any sound output. Conversely, with arms 20 and 21 (arm 21 seen in FIG. 1) positioned in the intermediate or arms forward position shown in solid-line representation in FIG. 2, sound and control circuit 44 is caused by means set forth below in greater detail to produce speaking or singing type sounds which do not include harmonica type music. Finally, and in further accordance with the present invention, with arms 20 and 21 (arm 21 seen in FIG. 1) pivoted upwardly in the direction indicated by arrow 52 to the fully raised position shown by dashed-line representation 53, simulated harmonica 30 is positioned against mouth 14 providing a harmonica playing position for toy FIG. 10. Means set forth below in greater detail, respond to the fully raised position of arms 20 and 21 to cause sound and control circuit 44 to output harmonica type music. Concurrently, sound and control circuit 44 operates light emitting diode 33 (seen in FIG. 1) to provide flashing light within simulated harmonica 30 which is visible due to the transparent material from which harmonica 30 is fabricated.

Figure 3:
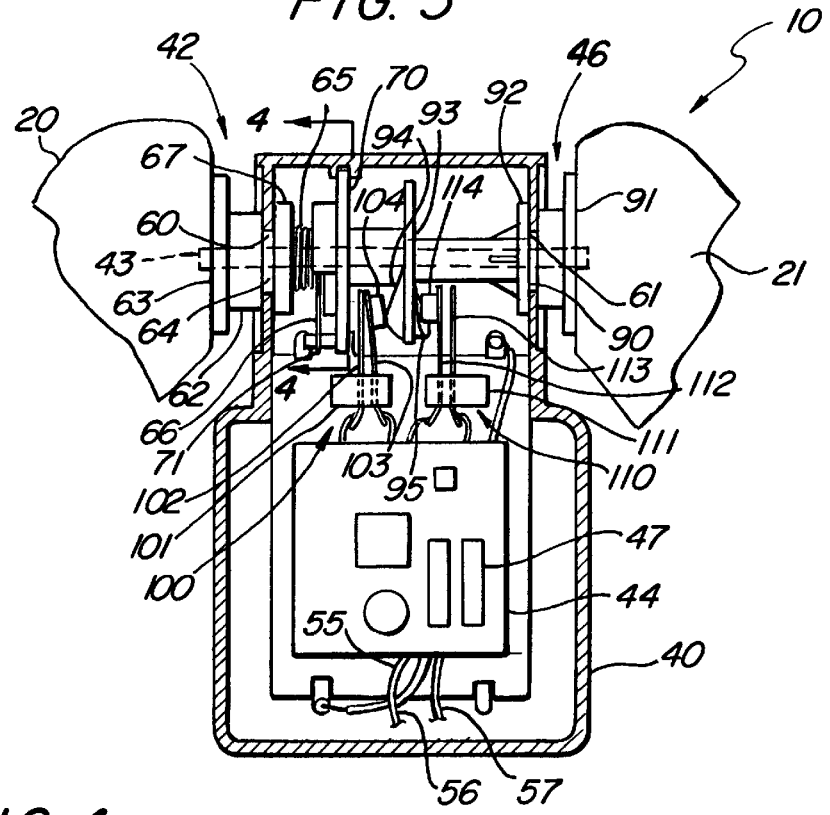
FIG. 3 sets forth a partial section view of the operative mechanism within the present invention toy figure.

FIG. 3 sets forth a partial section view of toy FIG. 10 showing the operative mechanism within housing 40. Toy FIG. 10 includes a pair of arms 20 and 21 secured to housing 40 by a pair of shoulder joints 42 and 46 respectively. Shoulder joints 42 and 46 provide the above described pivotal attachment of arms 20 and 21 to torso 12 (seen in FIG. 1). Thus, housing 40 is supported within the interior of torso 12 by conventional fabrication means (not shown). Housing 40 defines a pair of apertures 60 and 61. Aperture 60 rotatably supports shoulder joint 42 while aperture 61 rotatably supports shoulder joint 46.

More specifically, shoulder joint 42 includes a shoulder bearing 62 having an arm attachment 63 secured thereto. Shoulder joint 42 further includes a bearing 64 rotatably supported within aperture 60. A flange 67 is supported on the interior side of bearing 64 to maintain the position of bearing 64 within aperture 60. A detent plate 70 set forth below in FIG. 4 in greater detail is supported within the interior of housing 40 and further supports a detent rotor (seen in FIG. 4). A post 71 extends from detent plate 77 and receives end 66 of spring 65. Spring 65 is wound upon the interior portion of flange 67.

Shoulder joint 46 includes a bearing 90 rotatably supported within aperture 61 and a flange 92 supported within the interior of housing 40 to position bearing 90. Shoulder joint 46 further includes an arm attachment 91. An elongated square cross sectioned shaft 43 extends between shoulder joints 42 and 46. The square cross section of shaft 43 secures arm attachments 63 and 91 such that arms 20 and 21 pivot together about apertures 60 and 61 of housing 40. A switch wheel 93 having a pair of switch cams 94 and 95 supported on opposite side thereof is coupled to shaft 43 and rotatable therewith.

Housing 40 further supports a sound and control circuit 44 fabricated in accordance with conventional fabrication techniques and including a plurality of electronic components such as components 47. Sound and control circuit is operatively coupled to batteries 41 (seen in FIG. 2) by a plurality of wires such as wire 55. A further plurality of wires 56 and 57 operatively couples sound and control circuit 44 to speaker 45 (seen in FIG. 2).

Sound and control circuit 44 further includes a pair of switches 100 and 110 supported with housing 40 by a pair of switch blocks 101 and 111. Switch 100 includes a pair of elongated spring contacts 102 and 103 supported in a normally open or non-contacting position by block 101. This non-contacting position is better seen in FIG. 5 below. Similarly, switch 110 includes a pair of elongated spring contacts 112 and 113 supported in a non-contacting position by block 111. Switch contact 103 supports a block 104 which extends toward cam 94 of switch wheel 93. Similarly, spring contact 112 supports a block 114 which extends toward cam 95 of switch wheel 93.

Switches 100 and 110 are operated by cams 94 and 95 in accordance with the pivotal position of switch wheel 93. It will be recalled that switch wheel 93 is joined to shaft 43 and as a results pivots in accordance with the pivoting of arms 20 and 21. In the arm position shown in FIG. 3, which corresponds to the arms extended forward position shown in FIG. 1, cam 94 contacts block 104 and forces contact 103 against contact 102. As a result switch 100 is closed. Correspondingly, the position of switch wheel 93 shown in FIG. 3 moves cam 95 out of contact with block 114 leaving contacts 112 and 113 of switch 110 separated which in turn place switch 110 in an open switch position. Thus, in the arms forward pivotal position of arms 20 and 21 shown in FIG. 3, switch 100 is closed and switch 110 is opened. The closure of switch 100 causes sound and control circuit 44 to produce predetermined singing and/speaking type sounds for toy FIG. 10.

In further accordance with the present invention and as is described above, the pivoting of arms 20 and 21 to the fully lowered position shown in dashed-line representation 51 in FIG. 2 pivots switch wheel 93 such that cam 94 is moved away from contact with block 104. As a result, switch 100 returns to the open configuration in which contacts 102 and 103 are separated. The pivoting of switch wheel 93 in response to the arms lowered position moves cam 95 farther from block 114 allowing switch 110 to remain in the open condition shown in FIG. 3. As a result, sound and control circuit 44 ceases all sound output.

With arms 20 and 21 in the lowered position shown in dashed-line representation 51 in FIG. 2 and with both switches 100 and 110 in the open configuration, the upward pivotal movement of arms 20 and 21 rotates switch wheel 93. Once this upward pivotal movement reaches the arms forward position shown in FIG. 3, switch 100 is closed by the cooperation of cam 94 and block 104 while switch 110 remains open. Thus, the above described arms forward of position of FIG. 10 is accompanied by a singing and speech sound output from sound and control circuit 44. Thereafter, as arms 20 and 21 are further pivoted upwardly to the arms raised position shown in dashed-line representation 53 in FIG. 2, simulated harmonica 30 (also seen in FIG. 2) is positioned against the toy figures mouth. Correspondingly, switch wheel 93 is further pivoted by the upward pivotal movement of arms 20 and 21 moving cam 94 away from block 104 and allowing switch 100 to return to an open configuration. Correspondingly, the pivoting of switch wheel 93 moves cam 95 into contact with block 114 to the configuration shown in FIG. 5. This results in forcing contact 112 against contact 113 proving closure of switch 110. With switch 110 closed, sound and control circuit 44 produces output sounds corresponding to harmonica music.

Sound and control circuit 44 may be fabricated in accordance with conventional fabrication techniques utilizing an internal memory having stored audio data and a microprocessor having a stored instruction set to provide sound signal output. It will be well understood by those skilled in the art that virtually any standard sound circuit may be utilized as part of sound and control circuit 44. The essential characteristic of sound and control circuit 44 is the provision of appropriate signals to speaker 45 (seen in FIG. 2) for audiblizing a predetermined speech or singing message each time switch 100 is closed and for producing audible harmonica music each time switch 110 is closed. For example, a combination of a microprocessor, read-only memory, speech synthesizer, an audio output amplifier suitable for functioning within sound and control circuit 44 is formed as a single integrated circuit chip device manufactured by Texas Instruments, Inc. under the device name TMS 50C44. However, it will be understood that a variety of standard integrated circuit may be used within sound and control circuit 44.

Figure 4:
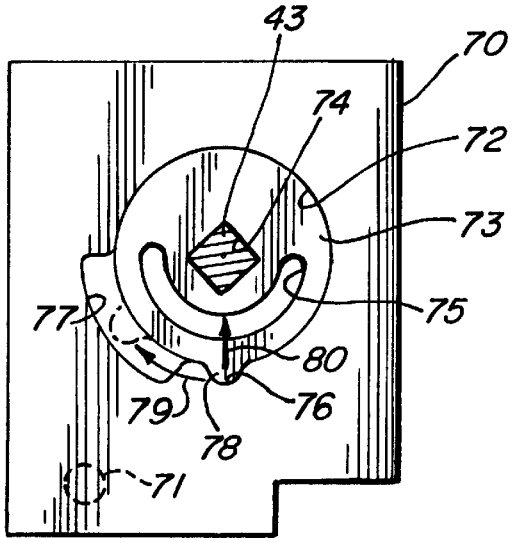
FIG. 4 sets forth a partial section view of the mechanism of FIG. 3 taken along section lines 4—4 therein.

FIG. 4 sets forth a partial section view of toy FIG. 10 taken along section lines 4—4 in FIG. 3. Toy FIG. 10 includes a plate 70 supported within housing 40 (seen in FIG. 3). Detent plate 70 defines a detent recess 72 having an arcuate slot 77 and a detent notch 76 formed therein. A detent rotor 73 includes a detent tab 78 and an arcuate slot 75. Detent rotor 73 defines a square aperture 74 which receives shaft 43 to support detent rotor 73 within detent recess 72. Slot 75 provides a spring action for the support of detent notch 76. A post 71 is supported upon detent plate 70 and receives spring end 66 of spring 65 (seen in FIG. 3).

In the position shown in solid-line representation in FIG. the arms (arms 20 and 21 seen in FIG. 3) are positioned in the arms lowered position shown dashed-line representation 51 in FIG. 2. Accordingly, detent tab 78 is received within detent notch 76. As a result, the force of spring 65 (seen in FIG. 3) is resisted and arms 20 and 21 (also seen in FIG. 3) are latched in the arms lowered position.

When arms 20 and 21 are pivoted upwardly, detent rotor 73 is pivoted in the direction indicated by arrow 79. The action of detent tab 78 and the resilient support thereof provided by slot 75 cooperate to require that the pivoting force upon arms 20 and 21 (seen in FIG. 3) be sufficient to overcome the detent action and move detent tab 78 from notch 76 into slot 77. Once detent tab 78 has moved into slot 77, no further resistance to pivoting movement is provided. When detent rotor 73 is again pivoted as arms 20 and 21 (seen in FIG. 3) are again pivoted to the arms lowered position, detent tab 73 is again received within notch 76 providing an arms down positioning.

Figure 5:
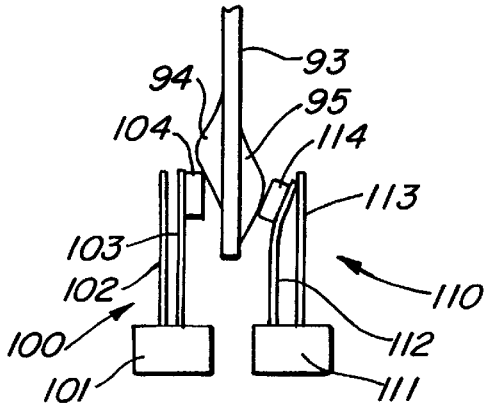
FIG. 5 sets forth a partial view of the switch mechanism of the present invention toy figure in the arms fully raised position.

FIG. 5 sets forth a partial view of switch wheel 93 in combination within switches 100 and 110. FIG. 5 shows the positions of switches 100 and 110 when switch wheel 93 is pivoted in response to the pivoting of arms 20 and 21 to the fully raised position shown in dashed-line representation 53 in FIG. 2. As described above, switch 100 includes a switch block 101 supporting a pair of spring contacts 102 and 103. Contact 103 further supports a block 104 extending toward switch wheel 93. Similarly, switch 110 includes a switch block 111 supporting a pair of spring contacts 112 and 113. Switch contact 112 further supports a block 114 extending toward switch wheel 93. In the position shown, cam 94 has moved beyond block 104 and as a result contacts 102 and 103 are separated and switch 100 is open. Conversely, the position of switch wheel 93 moves cam 95 against block 114 causing contact 112 to be moved against contact 113 providing closure of switch 110.

What has been shown is a toy figure which simulates musical instrument play in response to arm positioning. The simulated play includes establishing a first arm position in which no sound is produced by the internal sound and control circuit. An arms forward position causes the sound and control circuit to provide singing and/or speaking while a fully raises arm position places a simulated harmonica against the figures mouth to provide a harmonica play posture. Correspondingly, the sound and control circuit within the toy figure respond to the simulated harmonica play position by outputting sound corresponding to harmonica music.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a toy figure body having a torso, a pair of legs, a pair of arms, and a pair of hands supported on said arms and a head defining a mouth;

a pair of shoulder joints pivotally supporting said arms at said torso for movement between an arms lowered position, arms forward position and an arms raised position;

a common shaft joining said shoulder joints to provide common pivotal movement of said pair of arms;

a simulated musical instrument secured between said hands;

a sound and control circuit supported within said torso for producing first audible sounds and second audible sounds;

switch means coupled to said pair of shoulder joints operative in said arms forward position to cause said sound and control circuit to produce said first audible sounds and operative in said arms raised position to cause said sound and control circuit to produce said second audible sounds, said arms raised position positioning said simulated musical instrument against said mouth to posture said toy figure to simulate play of a musical instrument.

2. The toy figure set forth in claim 1 wherein said simulated musical instrument includes a light emitting diode coupled to said sound and control circuit and wherein said sound and control circuit blinks said light emitting when said arms are in said arms raised position.

3. The toy figure set forth in claim 2 wherein said simulated musical instrument is constructed to resemble a harmonica and wherein said second audible sounds resemble a harmonic sound.

4. The toy figure set forth in claim 3 wherein said switch means include a switch wheel joined to said shaft and having a pair of cams and a pair of switches coupled to said sound and control circuit operated between open and closed states by said cams.

* * * * *